US005694658A

United States Patent [19]

Huang et al.

[11] Patent Number: 5,694,658

[45] Date of Patent: Dec. 9, 1997

[54] FLEXIBLE TOOTHBRUSH

[75] Inventors: Pei Zhi Huang, San Gabriel, Calif.; Jian Zhi Wu; Rui Qing Lai, both of East Hills, Australia

[73] Assignee: Natural Sparkle IM/EX Co. Ltd., Alhambra, Calif.

[21] Appl. No.: 610,321

[22] Filed: Mar. 4, 1996

[51] Int. Cl.[6] ..... A46B 9/04

[52] U.S. Cl. ..... 15/167.1; 15/172

[58] Field of Search ..... 15/143.1, 144.1, 15/167.1, 172, 201

[56] References Cited

U.S. PATENT DOCUMENTS

| | | | |
|---|---|---|---|
| 882,021 | 3/1908 | Schigelinsky | 15/172 |
| 2,438,268 | 3/1948 | Bressler | 15/167.1 |
| 2,443,297 | 6/1948 | Bressler | 15/167.1 |
| 3,609,789 | 10/1971 | Slater | 15/167.1 |
| 4,829,621 | 5/1989 | Phenegar | 15/167.1 |
| 5,052,071 | 10/1991 | Halm | 15/172 |
| 5,054,154 | 10/1991 | Schiffer | 15/172 |

FOREIGN PATENT DOCUMENTS

| | | | |
|---|---|---|---|
| 0155730 | 9/1932 | Switzerland | 15/167.1 |
| 312125 | 2/1956 | Switzerland | 15/167.1 |
| 0673516 | 6/1952 | United Kingdom | 15/167.1 |
| 1158936 | 7/1969 | United Kingdom | 15/201 |
| 8801480 | 3/1988 | WIPO | 15/167.1 |
| 0015627 | 8/1993 | WIPO | 15/167.1 |

*Primary Examiner*—David Scherbel
*Assistant Examiner*—Randall Chin
*Attorney, Agent, or Firm*—Thomas I. Rozsa; Tony D. Chen

[57] ABSTRACT

A flexible toothbrush comprises a head portion, a neck portion and a handle portion. The head portion is integrally formed with the neck portion such that it is at an angle of approximately 0° to 20°. The neck potion has a hollow chamber, where a leaf-spring is embedded within the hollow chamber and is bendable for providing flexibility on the neck portion for enhancing the brushing of an individual's teeth.

11 Claims, 2 Drawing Sheets

FLEXIBLE TOOTHBRUSH

BACKGROUND OF THE INVENTION

1. Field of the Invention

The present invention generally relates to the field of dental care. More particularly, the present invention relates to the field of toothbrushes.

2. Description of the Prior Art

Prior art toothbrushes are comprised of a head portion with bristles, a neck portion and a handle portion. It is common to have the head portion aligned with the handle portion to form a standard straight toothbrush. The problem with this straight toothbrush is that the head portion is not bendable, thereby providing less reach when an individual brushes his or her teeth. Another prior art toothbrush has a head portion that is bent at an angle to provide improved reach when brushing. However, this prior art toothbrush is made of a solid plastic material, where the plastic material is rigid which does not provide flexibility when brushing. The plastic material can crack after time, thereby causing injure to the gums of the individual.

It is highly desirable to have a very efficient and also very effective design and construction of a flexible toothbrush, where the neck portion is improved to provide flexibility for an individual to brush his or her teeth. It is also desirable to provide a flexible toothbrush that is made of a semi-rigid plastic material, where the neck portion can be bendable under pressure and will not crack when brushing.

SUMMARY OF THE INVENTION

The present invention is a novel and unique flexible toothbrush for enhancing the brushing of an individual.

The flexible toothbrush comprises a head portion, a neck portion and a handle portion. The head portion is integrally formed with the neck portion such that it is at an angle of approximately 0° to 20°. The neck portion has a hollow chamber, where a leaf-spring is embedded within the hollow chamber and is bendable for providing flexibility on the neck portion for enhancing the brushing of an individual.

It is therefore an object of the present invention to provide a toothbrush, where the toothbrush has a head portion, a neck portion and a handle portion such that the head portion is formed at an angle of approximately 0° to 20° for improving the reach to brush an individual's teeth. The neck portion has a flexible leaf-spring integrally formed for increasing the flexibility of the neck portion so that the neck portion is bendable for enhancing the brushing of the individual's teeth.

It is a further object of the present invention to provide a toothbrush having a neck portion, where the neck portion has slot apertures thereon, so that the slot apertures provide increase flexibility on the neck portion, thereby preventing the plastic material used to make the toothbrush from cracking.

In the preferred embodiment of the present invention, the toothbrush is comprised of a head portion, a neck portion and a handle portion. The neck portion has a front side with a slot aperture, a back side with a slot aperture and a hollow chamber. A spring tension is centrally embedded within the hollow chamber such that it is between the slot apertures on the front and back sides of the neck portion.

In an alternative embodiment of the present invention, the spring tension is embedded within the hollow chamber and located adjacent to the front side of the neck portion.

In another alternative embodiment of the present invention, the spring tension is embedded within the hollow chamber and located adjacent to the back side of the neck portion.

In a further embodiment of the present invention, the spring tension is attached to an exterior surface which is located on the front side of the neck portion.

In an additional embodiment of the present invention, the spring tension is attached to an exterior surface which is located on the back side of the neck portion.

In still another embodiment of the present invention, two spring tensions are attached to an exterior surface and located on the front and back sides of the neck portion.

In still a further embodiment of the present invention, the spring tension comprises at least three flexible spaced apart cylindrical members embedded within the hollow chamber of the neck portion.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Figure 1:
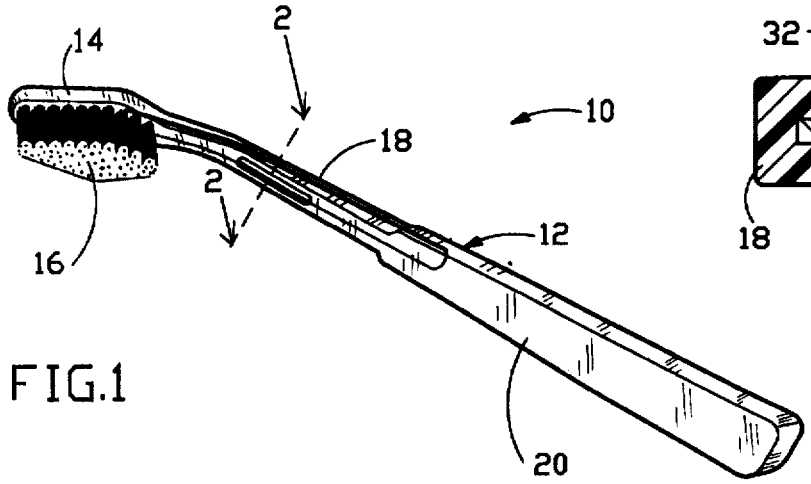
FIG. 1 is a perspective view of the preferred embodiment of the present invention flexible toothbrush.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 4, there is shown a preferred embodiment of the present invention flexible toothbrush 10. The toothbrush 10 is generally an elongated rectangular shaped body 12 which has a head portion 14 with bristles 16, a neck portion 18 and a handle portion 20. Each of the portions 14, 18 and 20 of the toothbrush 10 have a distal end 28 and a proximal end 30. The proximal end 30 of the head portion 14 is integrally formed with the distal end 28 of the neck portion 18 such that the head portion 14 is at an angle "A" in the range of approximately 0°–20°, preferably 20°. The proximal end 30 of the neck portion 18 is integrally formed with the distal end 28 of the handle portion 20.

The neck portion 18 has a front side 20, a back side 22 and a hollow chamber 24. Each side of the neck portion 18 has a slot aperture 26 which communicates with the hollow chamber 24. The slot apertures 26 are provided for increasing the flexibility of the neck portion 18 and preventing the plastic material used to make the toothbrush 10 from cracking when pressure is applied to bend the neck portion 18.

Figure 2:
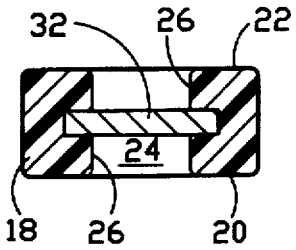
FIG. 2 is an enlarged cross-sectional view taken along line 2—2 of FIG. 1.
Figure 3:
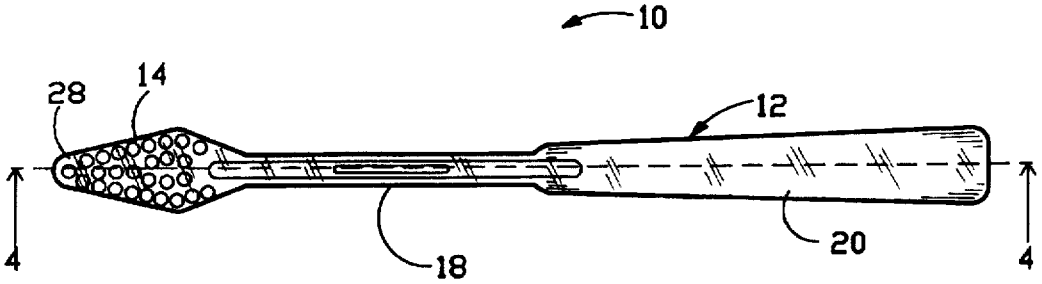
FIG. 3 is a plan view of the present invention flexible toothbrush.
Figure 4:
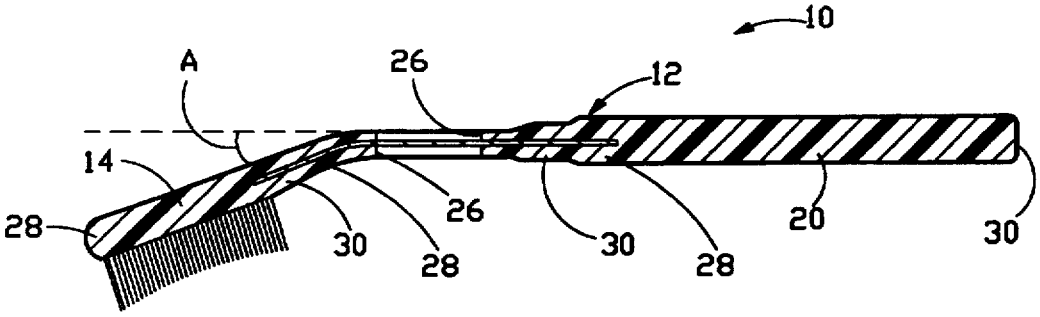
FIG. 4 is a cross-sectional view taken along line 4—4 of FIG. 3.

Referring to FIGS. 2 and 4, there is shown a flexible leaf-spring or spring tension means 32 which is centrally located and embedded within the hollow chamber 24 on the neck portion 18 of the elongated body 12. The flexible spring tension means 32 extends from the proximal end 30 of the head portion 14 to the distal end 28 of the handle portion 20 (see FIG. 4). The spring means 32 is located between the slot apertures 26, where the slot aperture exposes part of the spring means 32. The spring means 32 assists in bending the neck portion 18 when pressure is applied to the head portion 14 of the toothbrush 10 for providing flexibility on the neck portion 18 for enhancing the brushing of an individual's teeth.

Figure 5:
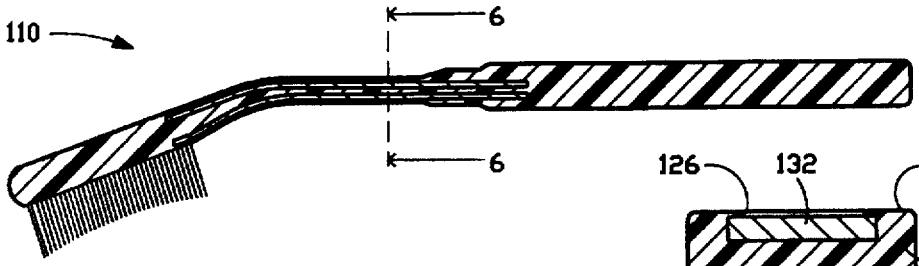
FIG. 5 is a longitudinal cross-sectional of an alternative embodiment of the present invention toothbrush.
Figure 6:
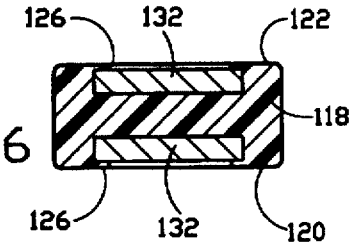
FIG. 6 is an enlarged cross-sectional view taken along line 6—6 of FIG. 5.

Referring to FIGS. 5 and 6, there are shown respective cross sectional views of an alternative embodiment of the present invention toothbrush 110. Since it assembles and functions the same as previously described above except that two spring tension means 132 are substituted for the single spring tension means 32 shown in FIGS. 1 through 4, the parts are numbered correspondingly with 1 00 added to each reference number. The two spring tension means 132 are integrally formed and located within the neck portion 118 and adjacent to the front and back sides 120 and 122 respectively. The neck portion 118 may have slot apertures 126 for increasing the flexibility of the neck portion 18 and preventing the plastic material used to make the toothbrush 110 from cracking.

Figure 7:
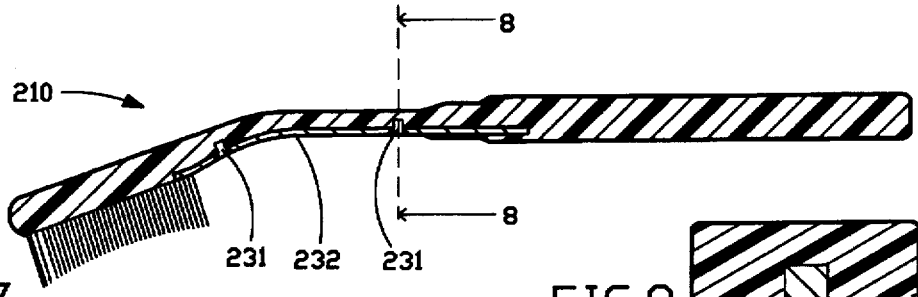
FIG. 7 is a longitudinal cross-sectional of another alternative embodiment of the present invention toothbrush.
Figure 8:
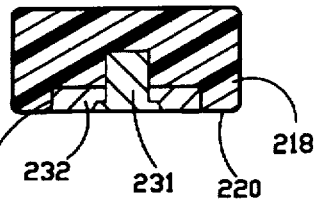
FIG. 8 is an enlarged cross-sectional view taken along line 8—8 of FIG. 7.

Referring to FIGS. 7 and 8, there are shown respective cross sectional views of another alternative embodiment of the present invention toothbrush 210. Since it assembles and functions the same as previously described in FIGS. 1 through 4 except that the spring tension means 232 may be mounted within a groove 219 formed on the neck portion 218 by two opposite screw pin means 231, and located adjacent to the front side 220. The spring tension means 232 may also be mounted to the exterior surface of the front side 220 of the neck portion 218, and therefore, the groove 219 will not be required.

Figure 9:
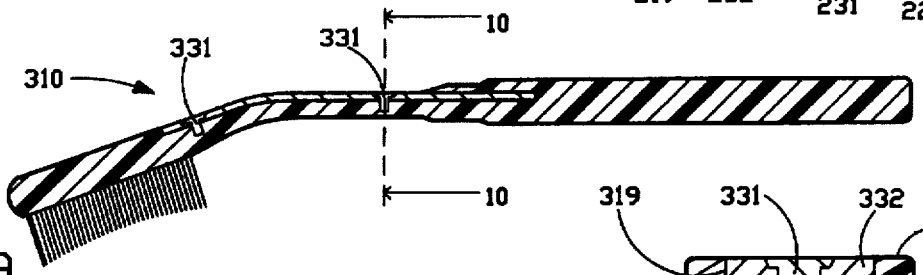
FIG. 9 is a longitudinal cross-sectional of a further alternative embodiment of the present invention toothbrush.
Figure 10:
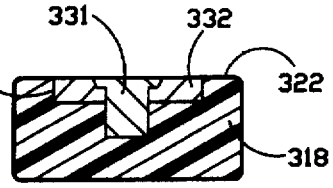
FIG. 10 is an enlarged cross-sectional view taken along line 10—10 of FIG. 9.

Referring to FIGS. 9 and 10, there are shown respective cross sectional views of a further alternative embodiment of the present invention toothbrush 310. Since it assembles and functions the same as previously described in FIGS. 1 through 4 except that the spring tension means 332 may be mounted within a groove 319 formed on the neck portion 318 by two opposite screw pin means 331, and located adjacent to the back side 322. The spring tension means 332 may also be mounted to the exterior surface of the back side 322 of the neck portion 318, and therefore, the groove 319 will not be required.

Figure 11:
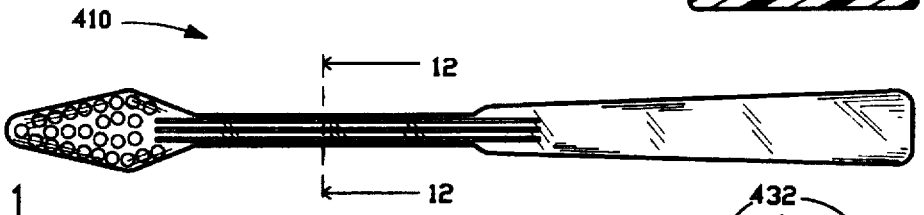
FIG. 11 is a plan view of still another alternative embodiment of the present invention toothbrush.
Figure 12:
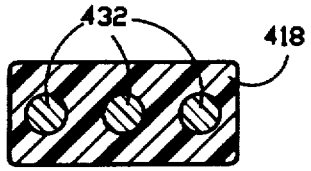
FIG. 12 is an enlarged cross-sectional view taken along line 12—12 of FIG. 11.

Referring to FIGS. 11 and 12, there are shown respective cross sectional views of a further alternative embodiment of the present invention toothbrush 310. Since it assembles and functions the same as previously described in FIGS. 1 through 4 except that the three flexible spaced apart cylindrical shaped members 432 are substituted for the single spring tension means 32 shown in FIGS. 1 through 4, the parts are numbered correspondingly with 400 added to each reference number. The three cylindrical shaped members 432 are integrally formed and centrally located within the neck portion 418.

It will be appreciated that the spring tension means is not limited to the illustrations shown in FIGS. 1 through 12. It is emphasized that while the spring tension means is preferably centrally embedded within the neck portion of the present invention, it is also within the spirit and scope of the present invention to have the spring tension means mounted at a multiplicity of different locations not shown.

The present invention conforms to conventional forms of manufacture or any other conventional way known to one skilled in the art. The toothbrush can be made from several materials. The manufacturing process which could accommodate the construction of the toothbrush may be injection, thermoform, etc. or other molding process. By way of example, the toothbrush can be made of plastic material while the spring tension means can be made of a flexible metal material.

Defined in detail, the present invention is a toothbrush, comprising: (a) a generally elongated body having a handle portion, a neck portion and a head portion, the neck portion having a front side, a back side and a hollow chamber, each side having a slot aperture communicating with the hollow chamber for increasing the flexibility of the neck portion, where the head portion is formed at an angle of approximately 20°; and (b) a flexible leaf-spring centrally embedded within said hollow chamber of said neck portion of said elongated body such that the leaf-spring is between said slot apertures of said front and back sides of said neck portion, where the leaf-spring is bendable for providing flexibility on said neck portion for enhancing the brushing of an individual; (c) whereby said slot apertures on said front and back sides of said neck portion increase the flexibility on said neck portion.

Defined broadly, the present invention is a toothbrush, comprising: (a) a body having a handle portion, a neck portion and a head portion, the neck portion having a hollow chamber and two Opposite sides, at least one of the two opposite sides having an opening communicating with the hollow chamber for increasing the flexibility of the neck portion, where the head portion is formed at an angle; and (b) spring tension means embedded within said hollow chamber of said neck portion of said body such that the spring tension means is located adjacent to said opening on said at least one of said two opposite sides of said neck portion, where the leaf-spring is bendable for providing flexibility on said neck portion for enhancing the brushing of an individual; (c) whereby said opening on said at least one of said two opposite sides of said neck portion increases the flexibility on said neck portion.

Defined more broadly, the present invention is a toothbrush, comprising: (a) a body having a handle, a neck and a head, where the head is positioned at angle such that it is not aligned with the handle and the neck; (b) at least one spring tension member incorporated to said neck of said body, where the at least one spring tension member improves the flexibility of said neck so that it can be bendable for enhancing the brushing of an individual; and (c) means on said neck for enhancing the flexibility of said neck.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A toothbrush, comprising:

a. a generally elongated body having a handle portion, a neck portion and a head portion, the neck portion having a front side, a back side and a hollow chamber, each side having a slot aperture for increasing the flexibility of the neck portion, where the head portion is formed at an angle of approximately 20° relative to the neck portion; and b. an angled flexible leaf-spring centrally embedded within said hollow chamber of said neck portion of said elongated body, and partially extending into said head portion and said handle portion such that the leaf-spring is between said slot apertures of said front and back sides of said neck portion, where the leaf-spring is bendable for providing flexibility on said neck portion for enhancing the brushing of teeth of an individual;

c. whereby said slot apertures on said front and back sides of said neck portion increase the flexibility on said neck portion.

2. The toothbrush in accordance with claim 1 wherein said elongated body is made of plastic material.

3. The toothbrush in accordance with claim 1 wherein said leaf-spring is made of flexible metal material.

4. A toothbrush, comprising:

a. a body having a handle portion, a neck portion and a head portion, the neck portion having a hollow chamber and two opposite sides, at least one of the two opposite sides having an opening for increasing the flexibility of the neck portion, where the head portion is formed at an angle relative to the neck portion; and b. angled spring tension means embedded within said hollow chamber of said neck portion of said body, and partially extending into said head portion and said handle portion such that the spring tension means is located adjacent to said opening on said at least one of said two opposite sides of said neck portion, where the spring tension means is bendable for providing flexibility on said neck portion for enhancing the brushing of teeth of an individual;

c. whereby said opening on said at least one of said two opposite sides of said neck portion increases the flexibility on said neck portion.

5. The toothbrush in accordance with claim 4 wherein said body is made of plastic material.

6. The toothbrush in accordance with claim 4 wherein said spring tension means is generally a leaf-spring.

7. The toothbrush in accordance with claim 6 wherein said leaf-spring is made of flexible metal material.

8. The toothbrush in accordance with claim 4 wherein said angle of said head portion is approximately in the range of 0° to 20°.

9. A toothbrush, comprising:

a. a body having a handle, a neck and a head, where the head is positioned at an angle relative to the neck, the neck having a front side and a back side;

b. at least one angled spring tension member incorporated to said neck of said body, and partially extending into said head and said handle, where the at least one spring tension member improves the flexibility of said neck so that it can be bendable for enhancing the brushing of teeth of an individual; and c. means on said neck for enhancing the flexibility of said neck, including slot apertures located on said front and back sides of said neck of said body.

10. The toothbrush in accordance with claim 9 wherein said at least one spring tension member is centrally located adjacent to said slot apertures of said front and back sides of said neck of said body.

11. The toothbrush in accordance with claim 9 wherein said at least one spring tension member is generally a leaf-spring.

* * * * *